US007262395B2

(12) United States Patent
Bilyk et al.

(10) Patent No.: US 7,262,395 B2
(45) Date of Patent: Aug. 28, 2007

(54) EXPENDABLE SONOBUOY FLIGHT KIT WITH AERODYNAMICALLY ASSISTED SONOBUOY SEPARATION

(76) Inventors: Derek Bilyk, 4 Chambers Avenue, Toronto, Ontario (CA) M6N 3L9; Patrick Zdunich, 313 Harbord, Toronto, Ontario (CA) M6G 1G9; Marc MacMaster, Apt. 1510, 755 Steeles Ave West, Toronto, Ontario (CA) M2R 2S6

( * ) Notice: Subject to any disclaimer, the term of this patent is extended or adjusted under 35 U.S.C. 154(b) by 29 days.

(21) Appl. No.: 10/848,131

(22) Filed: May 19, 2004

(65) Prior Publication Data

US 2005/0258310 A1 Nov. 24, 2005

(51) Int. Cl.
*F42B 17/00* (2006.01)

(52) U.S. Cl. ..... 244/14

(58) Field of Classification Search ..... 244/63, 244/14, 120, 3.25, 2, 47, 91; 102/384–386
See application file for complete search history.

(56) References Cited

U.S. PATENT DOCUMENTS 1,275,445 A * 8/1918 Kocialek ..... 244/14
1,448,166 A * 3/1923 Strong ..... 244/3.29
2,423,090 A * 7/1947 Fink et al. ..... 244/16
2,791,867 A * 5/1957 Dasher ..... 446/95
2,992,794 A * 7/1961 Boyd ..... 244/3.15
4,896,845 A * 1/1990 Peretti et al. ..... 244/3.1
4,999,816 A * 3/1991 Dale et al. ..... 367/4
5,035,382 A * 7/1991 Lissaman et al. ..... 244/190
5,100,081 A * 3/1992 Thomas ..... 244/220
6,293,202 B1 * 9/2001 Woodall et al. ..... 102/387

* cited by examiner

*Primary Examiner*—Tien Dinh
(74) *Attorney, Agent, or Firm*—Katten Muchin Rosenman LLP

(57) ABSTRACT

A flight kit that can be retrofitted to existing navy sonobuoys. The preferred embodiment gives sonobuoys the capability of self-deployment, allowing them to be sent to a location remotely without the use of manned aircraft or recoverable unmanned air vehicles. This capability is advantageous in instances where it is desired to place a sonobuoy in an area hostile or hazardous to manned aircraft. The preferred embodiment is an attachment of a GPS navigation and control system, wings, control surfaces, and a propulsion system, onto a naval size-A sonobuoy, using the sonobuoy as the central structural load-bearing component of the assembly. The invention navigates from a launch point on a ship to a designated position, where the sonobuoy separates from the invention, using the wings' aerodynamic forces to mechanically assist in separating the sonobuoy from the flight kit. The sonobuoy and the flight kit enter the water separately to ensure no interference with the sonobuoy.

16 Claims, 3 Drawing Sheets

EXPENDABLE SONOBUOY FLIGHT KIT WITH AERODYNAMICALLY ASSISTED SONOBUOY SEPARATION

BACKGROUND OF THE INVENTION

1. Field of the Invention

The present invention relates to the deployment of sonobuoys, more particularly to a device that enables the deployment of sonobuoys by air from a ship without the need of a manned or recoverable unmanned aircraft.

2. Description of the Prior Art

Sonobuoys have been used for decades as a method of tracking and detecting submarines, relying on acoustic sensors to detect submarine noises. Currently, these expendable devices are deployed from helicopters or fixed wing aircraft. Although the performance of these manned aircraft is effective, there still remains a risk to the flight crew when deploying sonobuoys in areas where an enemy threat exists at the desired sonobuoy drop location, such as over water near a hostile coastline. To address this problem, there have been experimental uses of a small number of unmanned air vehicles over the last few decades for the delivery of sonobuoys from a ship to a remote location, but these vehicles are large and expensive, and as such they must retain sufficient energy on-board after deploying the sonobuoys to return to the ship to be recovered.

There exist a number of patents describing alternatives to manned aircraft methods of sonobuoy deployment. In U.S. Pat. No. 6,082,675, Woodall describes both an air-launched, glider configuration, and a surface-launched drone configuration. The glider configuration in this patent requires a separate aircraft to transport and release the glider. The drone configuration described in this example is imagined to a be a complete aircraft independent of the sonobuoy, to which the sonobuoy is temporarily connected and, once the sonobuoy has been dropped at a designated site, the drone flies back to be recovered at its launch point.

U.S. Pat. No. 5,973,994 to Woodall describes a method of delivering a sonobuoy by making use of mortar or rocket launchers, which describes the adaptation of sonobuoys for use in ship based mortar or rocket launchers, as well as stabilizing fins for use during its arced trajectory.

U.S. Pat. No. 6,498,767 to Carreiro describes a method of delivering sonobuoys by adapting them to be deployed by a cruise missile, in turn requiring a large complex and expensive vehicle (the cruise missile) to deliver multiple sonobuoys. The cruise missile described in this example is considered to have turbine propulsion, as is typical of high-speed cruise missile weapons.

Although not directly related to sonobuoys, the prior art in guided munitions is in a similar field of invention. In U.S. Pat. No. 6,237,496, Abbot describes a GPS guided munition, wherein a tailfin assembly is retrofitted to a munition so as to facilitate guidance of the munition. In U.S. Pat. No. 5,615,846, Shmoldas describes an extendable wing for guided missiles and munitions, where a wing kit is attached to a munition to act as a range extender. In U.S. Pat. No. 6,293,202, Woodall describes an airborne deployed GPS guided torpedo.

From these, it can be observed that there exist patents for various means of air delivery of standard naval sonobuoys without the use of manned aircraft, but their still remains a need for a small (portable), cost effective device to remotely deploy sonobuoys. It is the object of this invention to provide a flight kit that can be retrofitted onto existing navy sonobuoys to enable them to become self-deployable, wherein the sonobuoy itself is the central structural load-bearing component of the delivery assembly.

BRIEF SUMMARY OF THE INVENTION

The invention is a device used to retrofit existing, unmodified navy sonobuoys to enable them to self-deploy in an aircraft-like flight from a ship to a remote location. This invention provides a safer means of sonobuoy or other payload deployment in situations in which a significant threat to manned aircraft exists. Even if the threat to aircraft is low, this invention can inexpensively augment the coverage of existing aircraft, or free them to perform other duties. Furthermore, this invention gives sonobuoy deployment capability to ships without onboard aircraft. In addition, since a single ship may launch multiple sonobuoys in sequence and in different directions using this invention, several sonobuoys can enter the water at different locations almost simultaneously, rapidly forming an anti-submarine protection fence. Furthermore, the use of an autonomous on-board control system on the invention means that no personnel are required to pilot the invention to the target location.

The invention makes use of the sonobuoy itself as the central structural load-bearing member of a flying assembly. It consists of aerodynamic surfaces to provide lift and stability in flight, a propulsion system consisting of an electric motor driven propeller and single use battery, control surfaces and control surface actuators, such as servos, and an on-board control system that provides navigation and control signals to the invention. The concept is analogous to the way in which 'smart-bombs may use a regular ' dumb-bombs as the core of the system, but add guidance package components at the front and/or rear extremities of the weapon. In other words, the components of the flight kit are made to assemble onto an existing sonobuoy, and without the sonobuoy's presence, the invention does not constitute a flight vehicle. Desired co-ordinates for sonobuoy deployment can be entered into the on-board control system, and using a satellite navigation method (such as the use of received GPS signals for navigation), or a magnetic heading-based method, or an inertial-navigation based method, or a combination of these methods, the on-board control system provides the control signals to steer the aircraft to the target. At, or at an acceptable proximity to the sonobuoy deployment co-ordinates, the sonobuoy is separated from the other components of the flying assembly. Both the sonobuoy and the other components, which do not form a flyable assembly without the presence of the sonobuoy, fall and enter the water separately so as not to interfere with, or become entangled with, the sonobuoy. The invention's flight control system may optionally have a wireless communications link so that the sonobuoy deployment co-ordinates may be updated while the invention is in flight, or so that the invention may report the exact coordinates of a successful delivery of the sonobuoy. The invention may be stored either fully assembled onto a sonobuoy, or in a disassembled state in order to save room. In addition, the invention may make use of an aerodynamically-driven actuation method in order to assist in separating the sonobuoy from the other components of the flying assembly. Normally, the wings of a rigid-wing aircraft are connected to the fuselage of an aircraft in such a way that the lift force on the wings is resisted by a connection between the wings and the fuselage that keeps the wings in approximately the same position and orientation relative to the fuselage. However, the invention is novel in that, at the time of sonobuoy separation, the wings are permitted to rotate upward (about a hinge-axis) that is a) at or near to the point where the left wing meets the right wing, and b) oriented approximately parallel to the direction of travel, in such a way that the wing tips will come together above the sonobuoy. The invention mechanically couples this aerodynamically-driven motion to assist in separating the sonobuoy from the other flight-kit components.

The invention differs from the prior methods of sonobuoy delivery in that it recognizes that sonobuoys themselves are built very strongly, and as such have the ability to act as a primary load-carrying structural member of a flying device. In this way, rather than simply carrying the sonobuoy as a passenger (as has been proposed in methods in which the sonobuoy is deployed by recoverable UAVs or drones), the sonobuoy is used as the central structural load-bearing member of the complete flight kit. The result is that the assembled flight kit plus sonobuoy may be lighter and more compact than a complete sonobuoy-carrying UAV or drone built of similar materials and layout that only carries the sonobuoy and does not incorporate it as a part of the structure. This weight savings coupled with the fact that the flight kit does not need to retain enough on-board energy to return to a recovery point after dropping the sonobuoy potentially gives the invention greater than twice the range of a similarly sized and powered recoverable UAV.

The invention utilizes an electric motor and single use battery. This makes for simple, quiet, reliable, push-button operation and removes the need for starting equipment, fuel and lubrication that are required for fuel burning engines.

The invention is nominally assembled onto a sonobuoy, however it may be assembled onto any other useful item that is constructed so as to provide a structural core in the same way that the sonobuoy does. In order for this other item to be used, it would need to be manufactured so that it is externally approximately the same size and shape as a sonobuoy, and would need to be structurally capable of acting as the central load-bearing component of the assembly in the same way that the sonobuoy does. For example, it may be advantageous to package a VHF radio relay into a sonobuoy-like package such that the invention may be used to carry aloft a means of relaying over-the-horizon the signals that are transmitted by a sonobuoy that had been deployed by another flight kit. Similarly, chemical or biological warfare sensors may be packaged in this way. Furthermore, if the item that replaces the sonobuoy may be made smaller than a sonobuoy, then additional batteries or fuel may also be fitted into the sonobuoy-like package, which would be especially useful if the payload is a radio relay.

DETAILED DESCRIPTION OF THE INVENTION

Figure 1:
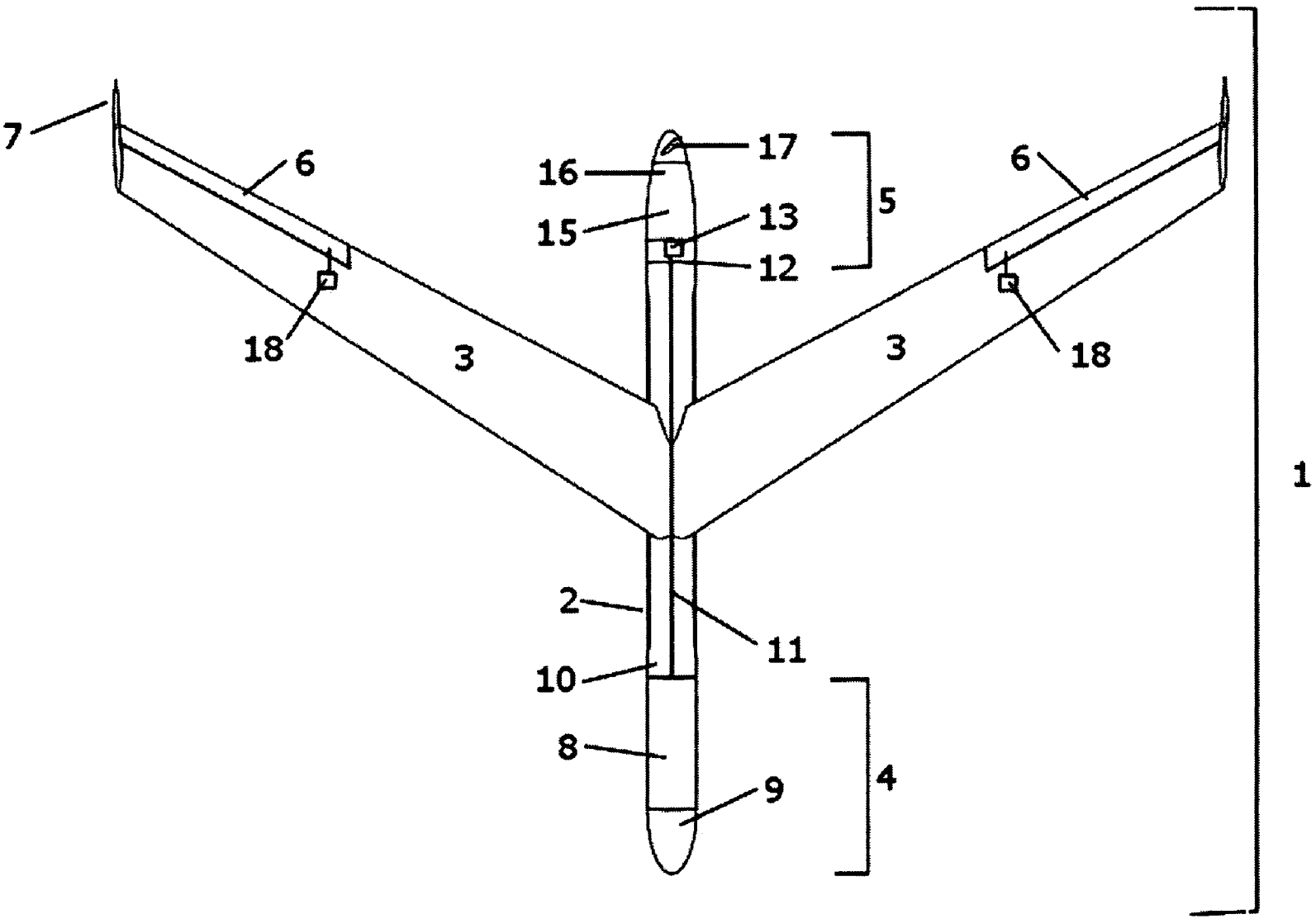
FIG. 1 is a top plan view of the preferred embodiment of the sonobuoy flight kit.

With reference to the drawings, the preferred embodiment of the invention (1) contains a standard Naval A-size sonobuoy (2) being the primary structural member onto which is attached the wings (3), a module forward of the sonobuoy (4) and a module aft of the sonobuoy (5). The wings (3) provide the requisite lift and through sweepback and twist also afford static stability in the usual manner for tailless designs. The invention need not be tailless but could be any aircraft configuration without violating the spirit of the invention, including a conventional tail aft design, canard design, tandem wing or joined wing design as it is not the configuration of the aerodynamic surfaces which sets this invention apart. The tailless design, however, is used as the preferred embodiment for the rest of this description. The flight control surfaces are of the standard type. While a full suite of pitch, yaw and roll controls may be used, a minimum configuration is desirable to reduce cost and weight due to fewer control actuators. In the example configuration there are only two control surfaces (6)—one at the trailing edge of each wing. These are called elevons and provide the function of both elevator (pitch control) and ailerons (roll control) Because of the dihedral in the wing, yaw is coupled with roll. For directional stability the example configuration has non-moving vertical stabilizers (7) at the wing tips.

The forward module (4) contains the single-use battery (8) that provides electrical energy to the invention and has a nose cone (9) that acts as an aerodynamic fairing.

Figure 2:
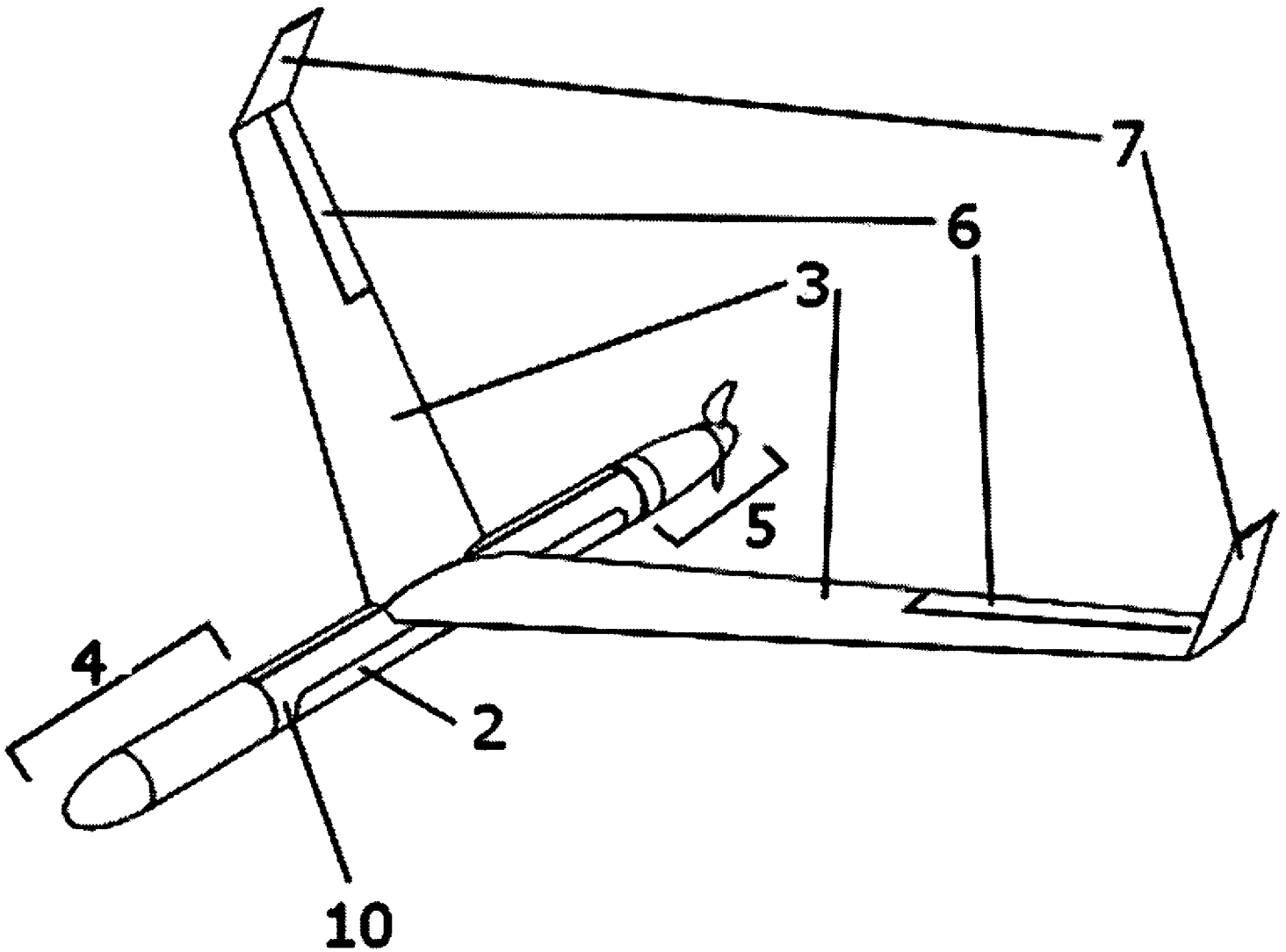
FIG. 2 is an isometric view of the preferred embodiment of the sonobuoy flight kit with wings in flight configuration.
Figure 3:
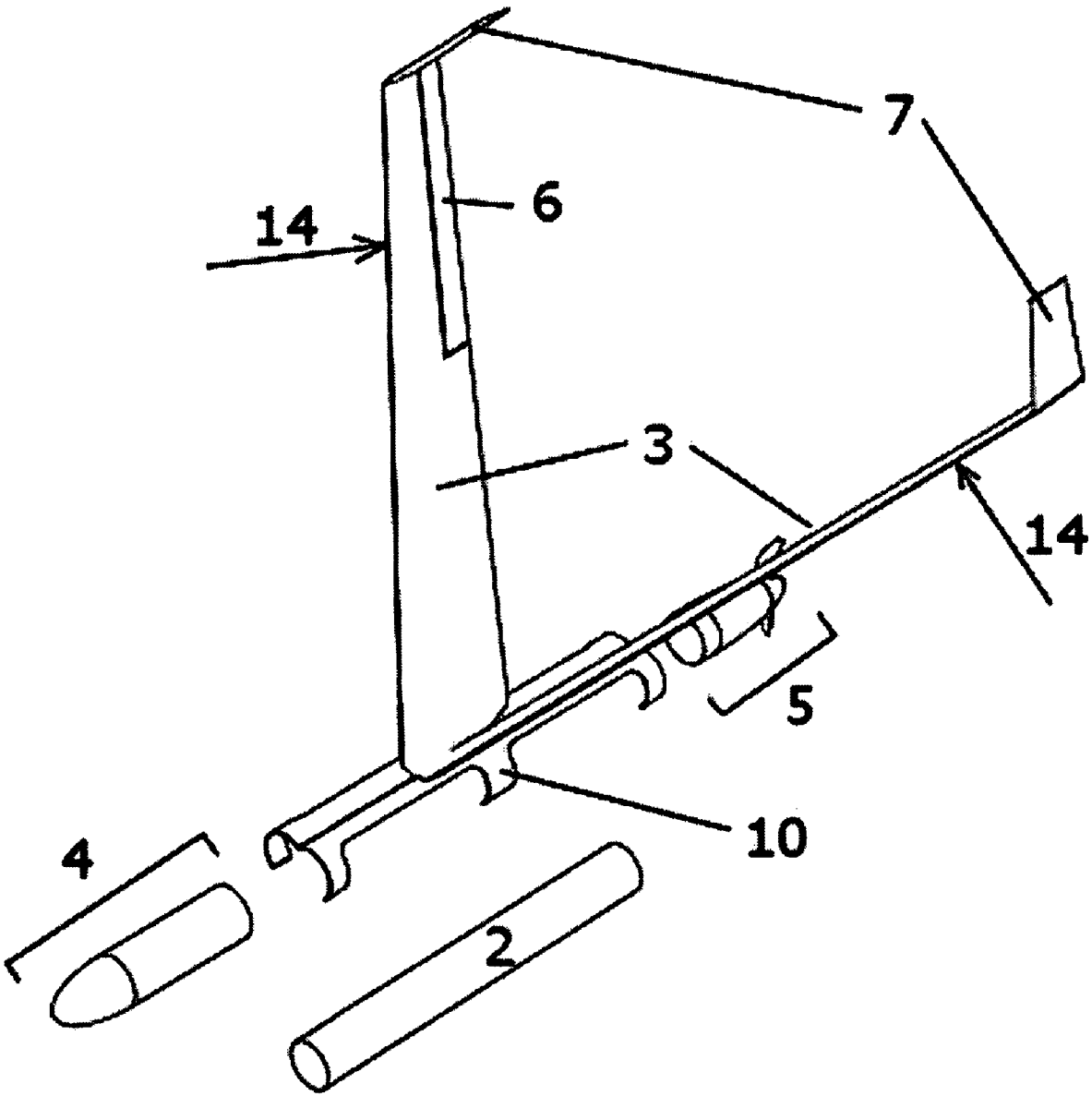
FIG. 3 is an exploded view of the independently falling sonobuoy flight kit components as they would appear shortly after the 'sonobuoy separation' had taken place.

The wings (3) are held to the sonobuoy structure by means of clamps (10). The wings, with the attached clamps are hinged at the top of the invention such that they may rotate about the hinge (11) so that the clamps encircle the sonobuoy. Extensions of the clamps fore and aft of the sonobuoy may act as flanges to clasp the forward module (4) and rear module (5). A locking device such as a pin (12) actuated by a servomotor (13) locks the clamps shut. When the locking pin is retracted, the wing lift (represented by arrows) (14) automatically deflects the wings and clamps and releases the sonobuoy (2). This is illustrated in FIGS. 2 and 3. With the wings no longer locked in place, they can no longer provide the requisite lift and the other sonobuoy flight kit components fall to the earth separately from the sonobuoy.

The rear module contains the flight control system (15) and the motor with motor controller (16) and propeller (17). The flight control system is designed with a bare minimum of functionality to keep the invention inexpensive. The flight control system takes desired coordinates and using a satellite navigation method (such as a GPS receiver), or a magnetic heading based method, or an inertial-navigation based method, or a combination of these methods, steers the aircraft to the target. Control actuators (18) are servomotors which take commands from the flight control system and move to actuate a control surface (6) and are located in the wings near the control surfaces. The electric motor and its controller (16) are located at the very back of the invention and drive a propeller (17) to provide thrust. This electric propulsion system is preferred because of its reliability and ease of operation.

Although the invention has been described in connection with a preferred embodiment, it should be understood that various modifications, additions and alterations may be made to the invention by one skilled in the art without departing from the spirit and scope of the invention as defined in the appended claims.

Advantageous features according to the preferred embodiments include the following.

An expendable flight kit, which attaches to a sonobuoy and makes use of said sonobuoy as the central structural load-bearing component of a flying assembly, comprising:

rigid aerodynamic surfaces that provide lift and stability; a method of propulsion; a plurality of control surfaces; a plurality of control surface actuators capable of moving control surfaces in response to control signals; a flight control system capable of receiving mission parameters, including sonobuoy deployment co-ordinates, and autonomously navigating and steering the vehicle in flight using information from a GPS receiver and attitude sensors and airspeed sensors, and capable of sending control signals to control surface actuators; a method for said flying assembly to be launched from a ship; a method of separating the sonobuoy from the flight kit components while in flight at an acceptable proximity to a pre-designated set of geographic co-ordinates; wherein after separation of the sonobuoy from the flight kit, both the sonobuoy and the flight kit components fall into the water.

The flight kit as recited above, wherein the aerodynamic surfaces are of a conventional rigid wing configuration, having a main wing with a stabilizing surface aft of it.

The flight kit as recited above, wherein the aerodynamic surfaces are of a canard rigid wing configuration, having a main wing with a stabilizing surface ahead of it.

The flight kit as recited above, wherein the aerodynamic surfaces are of a tandem rigid wing configuration, having two lifting surfaces of approximately equal size.

The flight kit as recited above, wherein the aerodynamic surfaces are of a tailless rigid wing configuration, having a main wing and no additional surfaces to provide longitudinal stability, The flight kit as recited above, wherein the tailless rigid wing configuration is a rigid flying wing configuration.

The flight kit as recited above, wherein the aerodynamic surfaces are of a three-surface rigid wing configuration, having a main wing with a stabilizing surface ahead of the main wing, and an additional stabilizing surface aft of the main wing.

The flight kit as recited above, wherein the aerodynamic surfaces are of a biplane rigid wing configuration, having two wings wherein one wing is placed approximately above the other wing.

The flight kit as recited above, wherein the aerodynamic surfaces are of a rigid diamond wing configuration, having two wings, one placed ahead of the other, wherein the tips of the forward wings are connected to the tips of the aft wing.

The flight kit as recited above, wherein the aerodynamic surfaces are of a rigid ring wing configuration.

The flight kit as recited above, wherein the method of propulsion includes an electric motor and an onboard source of electrical power.

The flight kit as recited above, wherein the onboard source of electrical power includes a battery.

The flight kit as recited above, wherein the onboard source of electrical power includes a fuel cell.

The flight kit as recited above, wherein onboard source of electrical power is a fuel-powered generator.

The flight kit as recited above, wherein the method of propulsion includes a propeller, a fan or a ducted fan.

The flight kit as recited above, wherein the method of propulsion includes more than one propeller or fan or ducted fan.

The flight kit as recited above, wherein the propulsion system includes a fuel-burning engine and its associated fuel tank.

The flight kit as recited above, wherein the fuel-burning engine is an internal combustion engine.

The flight kit as recited above, wherein the fuel-burning engine is a turbine engine.

The flight kit as recited above, wherein the method of propulsion includes a rocket.

The flight kit as recited above, as recited above, wherein the flight control system has the ability to communicate using a radio link with a control station located on a ship.

The flight kit as recited above, wherein the flight control system has the ability to communicate using a radio link with a control station located on land.

The flight kit as recited above, wherein the flight control system has the ability to communicate using a radio link with a control station located aboard a manned aircraft.

The flight kit as recited above, wherein the mission parameters may be transferred to the flight control system over a wired electrical link.

The flight kit as recited above, wherein the mission parameters may be transferred to the flight control system over an optical link.

The flight kit as recited above, wherein the flight control system includes a magnetometer or magnetic compass for determining magnetic heading.

The flight kit as recited above, wherein the flight control system includes an inertial navigation system.

The flight kit as recited above, wherein the GPS receiver has been removed.

The flight kit as recited above, wherein an alternative satellite navigation system receiver is used in addition to the GPS receiver.

The flight kit as recited above, wherein navigational information is provided to the flight control system from a ship or land or aircraft based RF transmitter.

The flight kit as recited above, wherein the sonobuoy is an unmodified naval A-size sonobuoy.

The flight kit as recited above, wherein the sonobuoy is a standard naval sonobuoy other than an unmodified naval A-size sonobuoy.

The flight kit as recited above, wherein the sonobuoy is a modified sonobuoy or custom sonobuoy.

The flight kit as recited above, wherein more than one sonobuoy is used as structural load-bearing components of a flying assembly.

The flight kit as recited above, wherein the flight kit attaches to and makes use of an alternative sonobuoy-shaped item instead of a sonobuoy as the central structural load-bearing component of the flying assembly.

The flight kit a recited above, wherein the alternative sonobuoy-shaped component contains a radio relay capable of re-transmitting signals from one or more sonobuoys that are in the water to a receiving site that is over-the-horizon from the sonobuoys.

The flight kit as recited above, wherein a portion of the alternative sonobuoy-shaped item is occupied by additional batteries or fuel.

The flight kit as recited above, wherein the alternative sonobuoy-shaped item contains a chemical sensor or biological agent sensor.

The flight kit as recited above, wherein sonobuoy separation from the other flight kit components is achieved by triggering a mechanism that uses the aerodynamic lift loads on the wings to release the sonobuoy from the other components.

The flight kit as recited above, wherein sonobuoy separation from the other flight kit components is assisted by triggering a mechanism that uses the aerodynamic lift loads on the wings to release the sonobuoy from the other components.

The flight kit as recited above, wherein sonobuoy separation from the other flight kit components is achieved or assisted by triggering the release of a pre-loaded spring mechanism.

The flight kit as recited above, wherein sonobuoy separation from the other flight kit components is triggered, achieved, or assisted by an active mechanism controlled by the flight control system.

An expendable flight kit, which attaches to an unmodified A-size naval sonobuoy and makes use of said unmodified A-size naval sonobuoy as the central structural load-bearing component of a flying assembly, comprising: aerodynamic surfaces for lift and stability, said aerodynamic surfaces being in a rigid-winged tailless configuration; a method of propulsion that includes an electric motor, a battery and a propeller; a plurality of control surfaces; a plurality of control actuators capable of moving control surfaces in response to control signals, said control actuators consisting of servomotors; a flight control system capable of receiving mission parameters, including sonobuoy deployment co-ordinates, through a wireless link and autonomously navigating and steering the vehicle in flight using information from a GPS receiver and attitude sensors and airspeed sensors, and capable of sending control signals to control surfaces actuators; a method for said flying assembly to be launched from a ship; a method of separating the sonobuoy from the flight kit components while in flight at an acceptable proximity to a pre-designated set of geographic co-ordinates, said method of separating the sonobuoy from the flight kit including the use of aerodynamic lift loads on the wings to release the sonobuoy from the other components; and wherein after separation of the sonobuoy from the flight kit, both the sonobuoy and the flight kit components fall into the water.

The flight kit as recited above, additionally including a method for said flying assembly to be launched from land.

The flight kit as recited above, additionally including a method for said flying assembly to be launched from an aircraft.

The flight kit as recited above, wherein the mission parameters may be transferred to the flight control system over a wired electrical link.

An expendable flight kit, which attaches to a naval sonobuoy and makes use of said naval sonobuoy as a structural component of a flying assembly, comprising: rigid aerodynamic surfaces for lift and stability; a method of propulsion that includes an electric motor, a battery and a propeller; a plurality of control surfaces; a plurality of control actuators capable of moving control surfaces in response to control signals, said control actuators consisting of servomotors; a flight control system capable of receiving mission parameters, including sonobuoy deployment co-ordinates, through a wireless link and autonomously navigating and steering the vehicle in flight using information from a GPS receiver and attitude sensors and airspeed sensors, and capable of sending control signals to control surfaces actuators; and a method for said flying assembly to be launched from a ship.

The invention claimed is:

1. An expendable flight kit attachable to a sonobuoy for making use of said sonobuoy as a central structural load-bearing component of a flying assembly, the kit comprising connecting structure configured to connect the flying assembly to the sonobuoy such that the sonobuoy is the central load-bearing component of the flying assembly;

rigid aerodynamic flight surfaces configured to provide lift and stability to the flying assembly;

a flight propulsion system;

a plurality of flight control surfaces;

a plurality of control surface actuators operable for moving the flight control surfaces in response to control signals; and a flight control system including (i) a GPS receiver and (ii) attitude and airspeed sensors, the flight control system being operable for receiving mission parameters including deployment co-ordinates, the flight control system being operable for autonomously navigating and steering the vehicle in flight using information from the GPS receiver and the attitude and airspeed sensors, the fight control system being operable for sending control signals to control the control surface actuators, the flying assembly operable to be launched from a ship;

the flight control system being operable for separating the sonobuoy from the flight kit while in flight, the flight control system causing (i) said connecting structure to open such that the sonobuoy is removed from said flight kit, and (ii) two of said rigid aerodynamic flight surfaces to move toward each other about an axis therebetween, wherein after separation of the sonobuoy from the flight kit, both the sonobuoy and the flight kit are configured to fall into the water.

2. The flight kit recited in claim 1, wherein the propulsion system includes an electric motor and an onboard source of electrical power.

3. The flight kit recited in claim 2, wherein the onboard source of electrical power includes a battery.

4. The flight kit recited in claim 1, wherein the propulsion system includes a propeller.

5. The flight kit recited in claim 1, wherein the flight control system includes a magnetometer or magnetic compass for determining magnetic heading.

6. The flight kit recited in claim 1, wherein the flight control system includes an inertial navigation system.

7. The flight kit recited in claim 1, wherein the sonobuoy comprises an unmodified naval A-size sonobuoy.

8. The flight kit recited in claim 1, wherein the sonobuoy comprises a standard naval sonobuoy other than an unmodified naval A-size sonobuoy.

9. The flight kit recited in claim 1, wherein the sonobuoy comprises a modified sonobuoy or custom sonobuoy.

10. The flight kit recited in claim 1, wherein the sonobuoy includes a radio relay.

11. The flight kit recited in claim 10, wherein the radio relay is capable of re-transmitting signals from one or more sonobuoys that are in the water to a receiving site that is over-the-horizon from the sonobuoys.

12. The flight kit recited in claim 10, wherein the sonobuoy contains a chemical sensor or a biological agent sensor.

13. The flight kit recited in claim 1, further comprising a triggering mechanism operable under the action of aerodynamic lift loads on the wings to release the sonobuoy from the flight kit.

14. The flight kit recited in claim 1, further comprising a pre-loaded spring mechanism for separating the sonobuoy from the flight kit.

15. The flight kit recited in claim 1, further comprising an active mechanism controlled by the flight control system for causing separation of the sonobuoy from the flight kit.

16. An expendable flight kit, which attaches to a naval sonobuoy to form a flying assembly, comprising:

connecting structure configured to connect the naval sonobuoy to the flying kit such that the sonobuoy is the central load-bearing component of the flying assembly, said connecting structure including clamps;

rigid aerodynamic surfaces configured to provide lift and stability to the flying assembly;

flight propulsion structure that includes an electric motor, a battery, and a propeller;

a plurality of flight control surfaces;

a plurality of control actuators capable of moving said control surfaces in response to control signals, said control actuators comprising servomotors;

a flight control system capable of (i) receiving mission parameters, including sonobuoy deployment coordinates, through a wireless link, (ii) autonomously navigating and steering the flying assembly in flight, (iii) sending control signals to said control surfaces actuators, and (iv) causing said clamps to open to release the sonobuoy from the flight kit while moving said rigid aerodynamic surfaces toward each other; and said flying assembly being operable to be launched from a ship.

* * * * *